US010899487B2

(12) United States Patent
Harth et al.

(10) Patent No.: US 10,899,487 B2
(45) Date of Patent: Jan. 26, 2021

(54) NOZZLE FOR INFLATING A SPOUT FILM BAG AND METHOD FOR INFLATING A SPOUT FILM BAG

(71) Applicant: INDAG Pouch Partners GmbH, Eppelheim (DE)

(72) Inventors: Rolf Harth, Neckargemünd (DE); Frank Lechert, Weinheim (DE)

(73) Assignee: INDAG POUCH PARTNERS GMBH, Eppelheim (DE)

( * ) Notice: Subject to any disclaimer, the term of this patent is extended or adjusted under 35 U.S.C. 154(b) by 84 days.

(21) Appl. No.: 15/750,371

(22) PCT Filed: Aug. 5, 2016

(86) PCT No.: PCT/EP2016/068754
§ 371 (c)(1),
(2) Date: Feb. 5, 2018

(87) PCT Pub. No.: WO2017/025464
PCT Pub. Date: Feb. 16, 2017

(65) Prior Publication Data

US 2018/0229876 A1 Aug. 16, 2018

(30) Foreign Application Priority Data

Aug. 7, 2015 (EP) ..... 15180153

(51) Int. Cl.
*B65B 43/58* (2006.01)
*B05B 1/00* (2006.01)
(Continued)

(52) U.S. Cl.
CPC ..... *B65B 43/58* (2013.01); *B05B 1/005* (2013.01); *B05B 13/069* (2013.01); *B08B 9/08* (2013.01);
(Continued)

(58) Field of Classification Search
USPC ..... 141/10, 68, 114, 166, 266, 284
See application file for complete search history.

(56) References Cited

U.S. PATENT DOCUMENTS 3,324,906 A * 6/1967 Chu ..... B67C 11/04 141/114
3,993,111 A * 11/1976 McLennand ..... B67C 3/26 141/90
(Continued)

FOREIGN PATENT DOCUMENTS

EP 1241096 A1 9/2002

OTHER PUBLICATIONS

European Search Report dated Jan. 7, 2016 in European Patent Application No. 15180153.7.
(Continued)

*Primary Examiner* — Daphne M Barry
(74) *Attorney, Agent, or Firm* — Mayer Brown LLP

(57) ABSTRACT

The invention relates to a nozzle for inflating a spout film bag, the lateral surface of which nozzle is designed in such a way that the nozzle can be inserted at least partially into the spout of the spout film bag and also at least partially into the interior of the spout film bag, wherein the lateral surface of the part of the nozzle that can be inserted has a bulging design. The invention further relates to a method for inflating a spout film bag by using said nozzle, comprising the following steps: providing the nozzle; inserting the nozzle into the spout of the spout film bag and lowering the nozzle in the spout to a first position; after the first position has been reached, wherein the lateral surface of the inserted nozzle interacts with the internal form of the spout in such a way that the interior of the spout film bag is substantially sealed, introducing flushing or inflating air into the interior of the spout film bag by means of the nozzle.

5 Claims, 5 Drawing Sheets

(51) Int. Cl.

| | |
|---|---|
| ***B65B 43/36*** | (2006.01) |
| ***B65B 55/02*** | (2006.01) |
| ***B08B 9/08*** | (2006.01) |
| ***B65B 55/10*** | (2006.01) |
| ***B08B 9/093*** | (2006.01) |
| ***B65B 55/24*** | (2006.01) |
| ***B05B 13/06*** | (2006.01) |
| ***B65B 31/04*** | (2006.01) |
| ***B65D 75/58*** | (2006.01) |
| ***B65D 75/00*** | (2006.01) |

(52) U.S. Cl.

CPC ..... *B08B 9/0813* (2013.01); *B08B 9/093* (2013.01); *B65B 31/042* (2013.01); *B65B 43/36* (2013.01); *B65B 55/022* (2013.01); *B65B 55/10* (2013.01); *B65B 55/24* (2013.01); *B65D 75/5866* (2013.01); *B08B 2209/085* (2013.01); *B65D 75/008* (2013.01)

(56) References Cited

U.S. PATENT DOCUMENTS 5,819,821 A * 10/1998 Giacomelli ..... B65B 39/001 141/263
2003/0196721 A1* 10/2003 Graffin ..... B67C 3/26 141/302
2012/0008884 A1 1/2012 Murray
2012/0132198 A1* 5/2012 Hausmann ..... A61M 11/06 128/200.14
2012/0261027 A1* 10/2012 Py ..... B65B 39/004 141/2
2013/0292592 A1* 11/2013 Py ..... F16L 29/02 251/149.6
2014/0034188 A1* 2/2014 Berger ..... B67C 3/26 141/8
2014/0261871 A1* 9/2014 Wetsch ..... B31D 5/0073 141/10
2014/0311617 A1* 10/2014 Py ..... A61J 3/002 141/1
2014/0353496 A1* 12/2014 Thomson ..... H01J 49/0404 250/289
2015/0122369 A1* 5/2015 Py ..... B65B 39/004 141/1
2017/0001848 A1* 1/2017 DiCarlo ..... B67C 3/225

OTHER PUBLICATIONS

English translation of the Search Report received in EP 15180153.7 and dated Jan. 7, 2016.
English translation of the Written Report received in PCT/EP2016/068754 and dated Oct. 5, 2016.

* cited by examiner

NOZZLE FOR INFLATING A SPOUT FILM BAG AND METHOD FOR INFLATING A SPOUT FILM BAG

CROSS-REFERENCE TO RELATED APPLICATIONS

This application is a U.S. national stage entry of International Application No. PCT/EP2016/068754, filed Aug. 5, 2016, which claims priority to European Application No. 15180153.7, filed Aug. 7, 2015, the contents of both of which are incorporated by reference herein in their entirety.

BACKGROUND OF THE INVENTION

1. Field of the Invention

The invention relates to a nozzle for inflating a spout film bag and a method for inflating a spout film bag.

2. Description of Related Art

For inflating a spout film bag, it is known to use a nozzle having a substantially circle-cylindrical outer shape and being inserted into the spout. The diameter of the cylinder is selected such that the spout is substantially sealed by the inserted nozzle and the spout film bag can be inflated by inserting flushing or inflating air.

In case the longitudinal axis of the nozzle and the longitudinal axis of the spout are not aligned with each other upon inserting the nozzle into the spout, the nozzle may seize in the spout due to the elongated cylinder area upon inserting into or removing the nozzle from the spout, thereby possibly damaging the spout. The consequence of such damage may be that the spout may no longer be duly closed with its cap and, thus, for instance, leakage of the closure may result.

SUMMARY OF THE INVENTION

It is the object of the present invention to provide a nozzle for inflating a spout film bag such that alignment errors in inserting the nozzle into the spout or removing the nozzle from the spout can be balanced and damage to the spout is avoided.

This object is solved by the nozzle and the method described herein. Preferred embodiments and variants are also disclosed.

The invention relates to a nozzle for inflating a spout film bag, the lateral surface of which is adapted to allow the nozzle to be at least partially inserted into the spout of the spout film bag and also at least partially into the interior of the spout film bag, wherein the lateral surface of the insertable portion of the nozzle is bulged.

To this end, the bulging design may be formed by a convex arc shape having a rounded configuration. In other cases, the bulging design may be formed by a double frustum cone, wherein the two frustum cones have a same maximum radius and abut with the circle area of maximum radius; and the bulging design has an angular configuration.

By providing the lateral surface of the insertable portion of the nozzle with a bulging design, a nozzle inserted into the spout of a spout film bag is able to cooperate with the interior form of the spout at a first position, a so-called sealing position, such that the interior of the spout film bag is substantially sealed. The sealing is achieved by substantially eliminating any space between the lateral surface of the nozzle and the spout due to the maximum outer circumference of the nozzle, i.e., the lateral surface in the vicinity of the bulging portion. That is, the sealing is accomplished substantially along a circle. Therefore, at the first position, the nozzle enables the introduction of flushing or inflating air into the interior of the spout film bag without leakage.

The first position is reached upon insertion of the nozzle into the spout when the maximum bulging of the lateral surface, that is, for example, the maximum outer circumference of the nozzle, is inserted into the spout, and the first position, i.e., the sealing position, is maintained, even when the nozzle within the spout is further lowered, as long as the maximum bulging, that is, for instance, the maximum outer circumference, is positioned within the spout.

Moreover, damage to the spout may be avoided in case the nozzle is inserted into the spout in a non-aligned manner, since contact between the lateral surface of the nozzle and the spout is established along a circle only.

At a second position, a so-called leakage position, at which the nozzle is more deeply inserted into the spout, the lateral surface of the inserted nozzle cooperates with the interior form of the spout such that a spacing is formed through which flushing or inflating air introduced into the spout film bag may at least partially leak from the interior of the spout film bag. The second position is, thus, reached when the maximum bulging of the lateral surface, that is, for example, the maximum outer circumference of the nozzle, is no longer positioned in the spout.

The lateral surface may be defined by a rotating surface of a convex arc curve by rotation around the longitudinal axis of the nozzle.

A first circle of latitude of the lateral surface may correspond to the maximum circumference of the nozzle, wherein any other circles of latitude of the lateral surface have radii that are less than the radius of the first circle of latitude. Preferably, the radii decrease continuously from the first circle of latitude towards the two ends of the nozzle.

The first circle of latitude may be substantially positioned in the center of the nozzle.

According to a method for inflating a spout film bag, the nozzle for inflating a spout film bag as described above or as will be described later on, is used, wherein the method comprises the following steps: providing a nozzle, the lateral surface of which is configured such that the nozzle is at least partially insertable into the spout of the spout film bag and is also at least partially insertable into the spout film bag, wherein the lateral surface of the insertable portion of the nozzle has a bulging configuration or design; inserting the nozzle into the spout of the spout film bag and lowering the nozzle within the spout to a first position, a so-called sealing position; after reaching the first position, wherein the lateral surface of the inserted nozzle cooperates with the interior form of the spout such that the interior of the spout film bag is substantially sealed, inserting flushing or inflating air into the interior of the spout film bag by the nozzle.

The nozzle may be arranged at an inflating device, wherein the inflating device may comprise a support or leverage configured such that the nozzle may be moved up and down parallel to its longitudinal axis along a vertical direction. In this manner, the nozzle may be inserted into the spout by lowering and may be lowered within the spout to a first position. Introducing flushing or inflating air into the interior of the spout film bag by means of the nozzle may be accomplished by a feeding system that connects to the nozzle. Consequently, the first position is reached upon inserting the nozzle into the spout when the maximum bulging of the lateral surface, that is, for example, the maximum outer circumference of the nozzle, is inserted into the spout, and the first position, that is, the sealing position, is maintained even when the nozzle in the spout is further lowered as long as the maximum bulging, that is, for example, the maximum outer circumference, is positioned within the spout.

Furthermore, the method may comprise the following steps: further lowering the nozzle within the spout to a second position, a so-called leakage position; after reaching the second position, wherein the lateral surface of the inserted nozzle cooperates with the interior form of the spout such that a spacing is formed, causing introduced flushing or inflating air introduced into the interior of the spout film bag to leak at least partially from the interior of the spout film bag.

Therefore, the second position is reached when the maximum bulging of the lateral surface, that is, for example, the maximum outer circumference of the nozzle, is no longer positioned in the spout. Hence, the spacing is formed by not having the maximum circumference of the nozzle within the spout, but having the maximum circumference positioned below the spout, that is, in the interior of the spout film bag.

In a subsequent step, the nozzle may be removed from the spout, preferably by an upward movement of the nozzle. Removal of the nozzle may be accomplished starting from the first position or starting from the second position.

BRIEF DESCRIPTION OF THE DRAWINGS

To gain a better understanding and visualization of the invention, aspects of the invention are illustrated as example in the attached figures. In the figures.

DETAILED DESCRIPTION OF THE INVENTION

Figure 1:
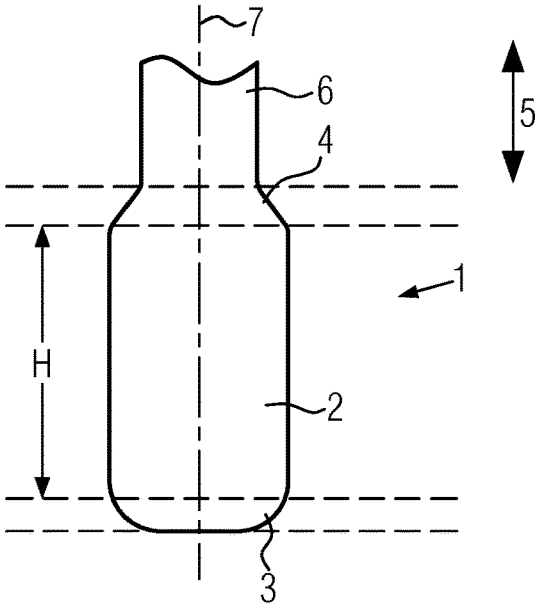
FIG. 1 (Prior Art)
FIG. 1 is a side view of a nozzle of the prior art for inflating a spout film bag.

FIG. 1 shows a side view of a conventional nozzle 1 for inflating a spout film bag. The nozzle 1 comprises a substantially circle-cylindrical outer shape 2 of height H transitioning at both ends of the nozzle into an inclined surface 3, 4. The nozzle 1 is movable up and down parallel to its longitudinal axis 7 along a vertical direction 5. For inflating a spout film bag, the nozzle 1 is inserted into the spout of the bag by a lowering step, such that through a cooperation of the interior form of the spout and the circle-cylindrical outer shape 2 of the nozzle 1 the interior of the spout film bag may be substantially sealed. By means of the nozzle 1, a feeding system 6 may then enable the introduction of flushing or inflating air into the interior of the spout film bag.

Figure 2:
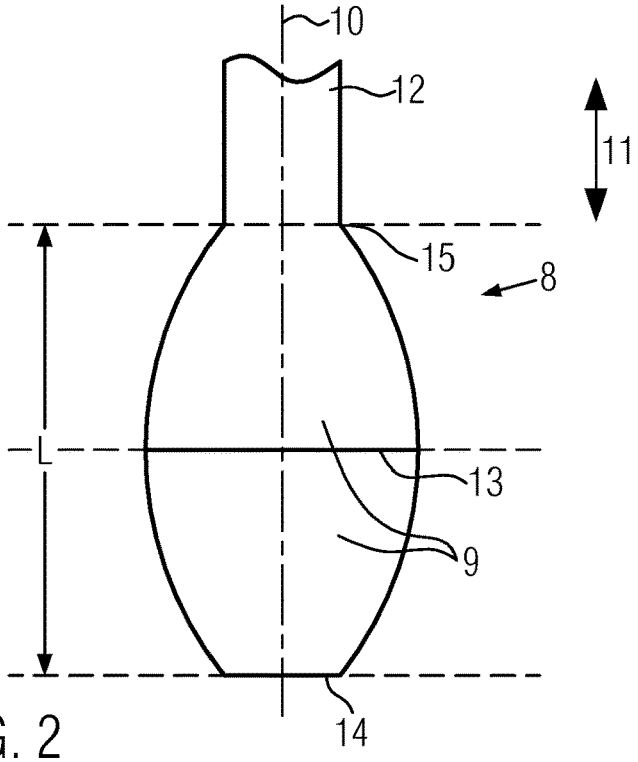
FIG. 2 is a side view of an embodiment of a nozzle for inflating a spout film bag.

FIG. 2 shows a side view of an embodiment according to the present invention relating to a nozzle 8 for inflating a spout film bag. The lateral surface 9 of the nozzle 8 is configured such that the nozzle 8 is at least partially insertable into the spout of the spout film bag and also at least partially insertable into the spout film bag, wherein the lateral surface 9 of the insertable portion of the nozzle 8 is bulged or has a bulging configuration. The nozzle 8 of length L is movable up and down parallel to its longitudinal axis 10 along a vertical direction 11. Flushing or inflating air may be introduced into the interior of the spout film bag by means of the nozzle 8 via a feeding system 12.

In the illustration, the lateral surface 9 of the nozzle 8 is bulged such that a maximum outer circumference, indicated by reference numeral 13, is positioned approximately at the middle of the nozzle. This maximum outer circumference 13 and, thus, the maximum outer diameter of the nozzle 8, are dimensioned such that the nozzle 8 is insertable into the spout of a spout film bag. The outer circumference and, thus, the outer diameter of the nozzle 8, decreases continuously, starting from the maximum outer circumference 13 in the middle of the nozzle having the corresponding maximum outer diameter, towards the two ends 14, 15 of the nozzle 8.

Typically, the nozzle has a length L between 2 cm and 5 cm and the maximum outer diameter of the nozzle is typically less than the inner diameter of the spout, into which the nozzle should be inserted by 0.2 mm to 0.5 mm. In this case, it is assumed that the inner diameter of the spout is substantially constant along the length of the spout.

Figure 3:
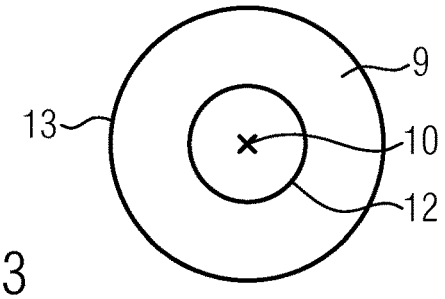
FIG. 3 is a top view of the nozzle of FIG. 2.

FIG. 3 is a top view of the nozzle 8 of FIG. 2. The smaller outer circumference of the upper end 15 of the nozzle 8 coincides substantially with the outer circumference of the feeding system 12, as is evident from the figure. The outer circumference decreases continuously towards the maximum outer circumference 13 of the nozzle 8.

Figure 4:
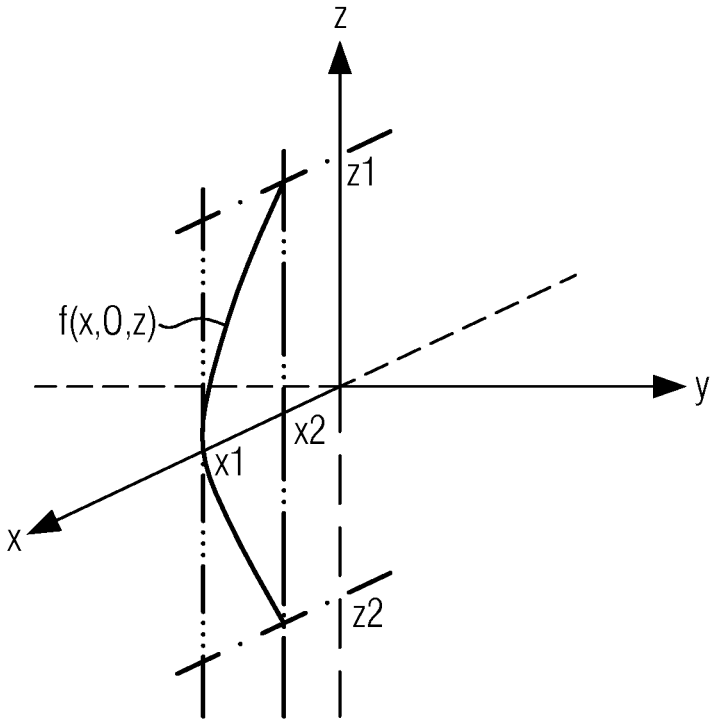
FIG. 4 is a convex arc curve for defining the lateral surface of the nozzle.

FIG. 4 shows a convex arc curve for defining the lateral surface of the nozzle 8. The planar convex function f(x,0,z) is defined in the x-z plane as an example, wherein the z-axis is to correspond to the longitudinal axis 10 of the nozzle 8. The value x1 corresponds to the maximum outer radius of the nozzle 8. The smaller outer radii of the two ends 14, 15 of the nozzle 8 are assumed to be of the same size and are assigned the value x2. The rotational surface corresponding to the lateral surface 9 of the nozzle 8 is obtained by a rotation of 360° around the z-axis. The length L of the nozzle 8 results from the sum of the amounts of z1 and z2.

Figure 5:
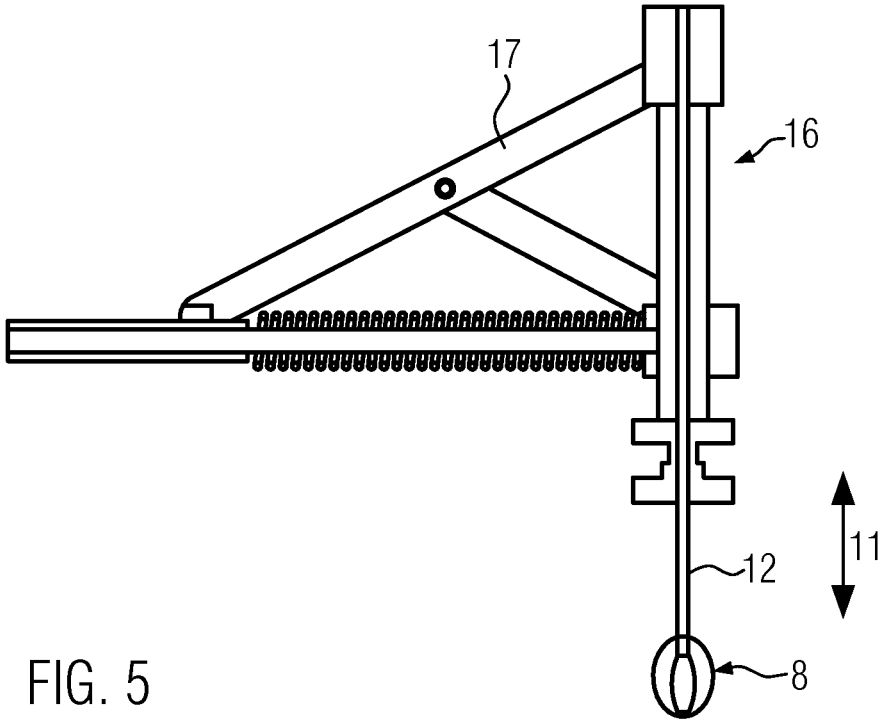
FIG. 5 is a side view for arranging the nozzle according to an embodiment of an inflating device.

FIG. 5 is a side view of an arrangement of the nozzle 8 in an embodiment of an inflating device 16. The inflating device 16 comprises a lever or support 17 that is configured to enable the nozzle 8 to be moved up and down parallel to its longitudinal axis 10 along a vertical direction 11.

Figure 6:
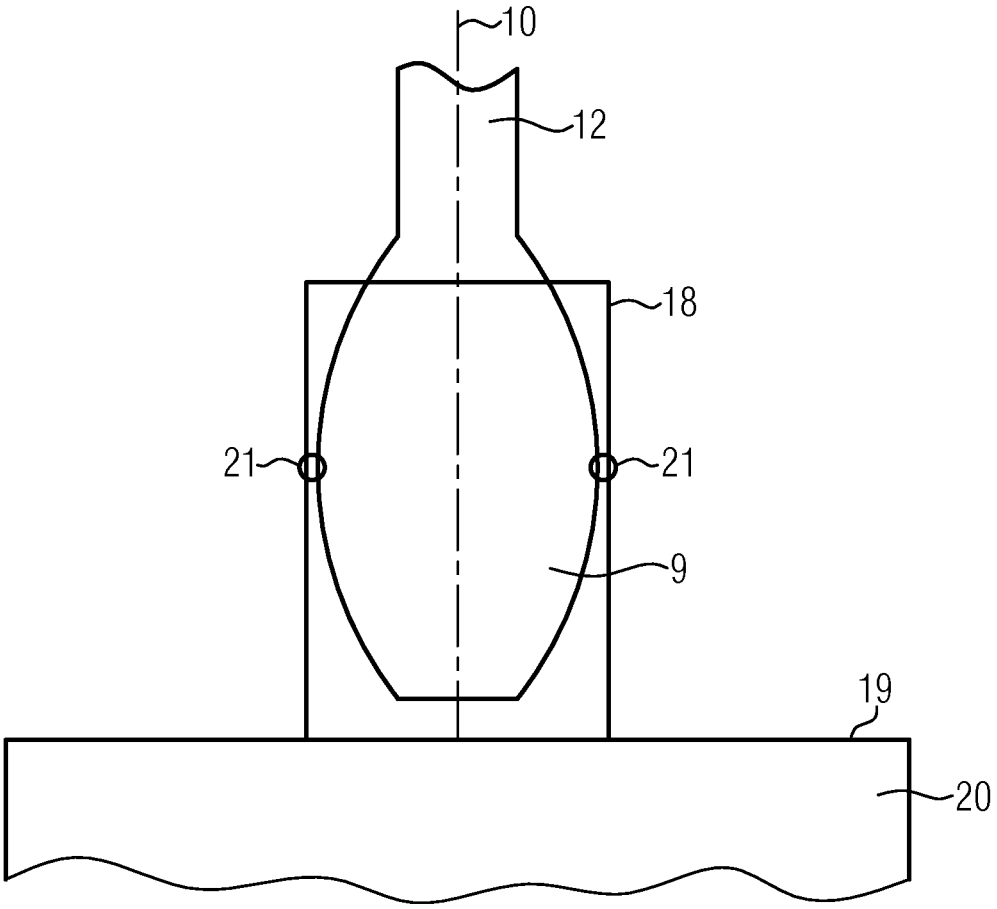
FIG. 6 is a side view of the inserted nozzle at a first position.

FIG. 6 is a side view of the nozzle 8 at a first position when inserted into the spout 18 of a spout film bag 19. The lateral surface 9 of the inserted nozzle 8 cooperates with the interior form of the spout at the first position such that the interior 20 of the spout film bag 19 is substantially sealed. The sealing is accomplished in that substantially no space remains between the lateral surface 9 of the nozzle 8 and the spout 18 due to maximum outer circumference 13 of the nozzle 8. That is, the sealing is accomplished substantially along a circle as schematically indicated by reference number 21. By disposing the nozzle 8 at the first position, flushing or inflating air may be introduced into the interior 20 of the spout film bag 19 without leakage.

Figure 7:
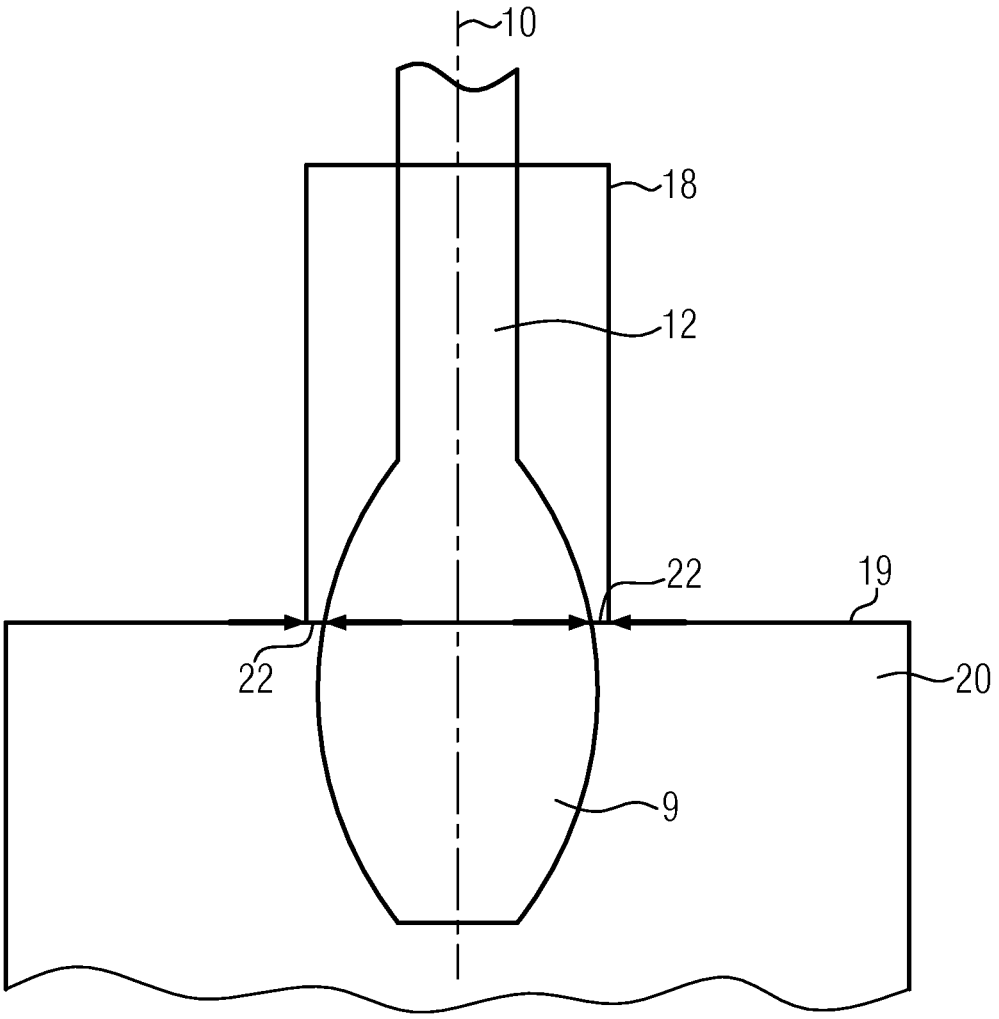
FIG. 7 is a side view of the inserted nozzle at a second position.

FIG. 7 is a side view of the inserted nozzle 8 at a second position. At the second position, the lateral surface of the inserted nozzle 8 cooperates with the interior form of the spout 18 such that a spacing 22 is formed, through which introduced flushing or inflating air may at least partially leak from the interior 20 of the spout film bag 19.

Figure 8:
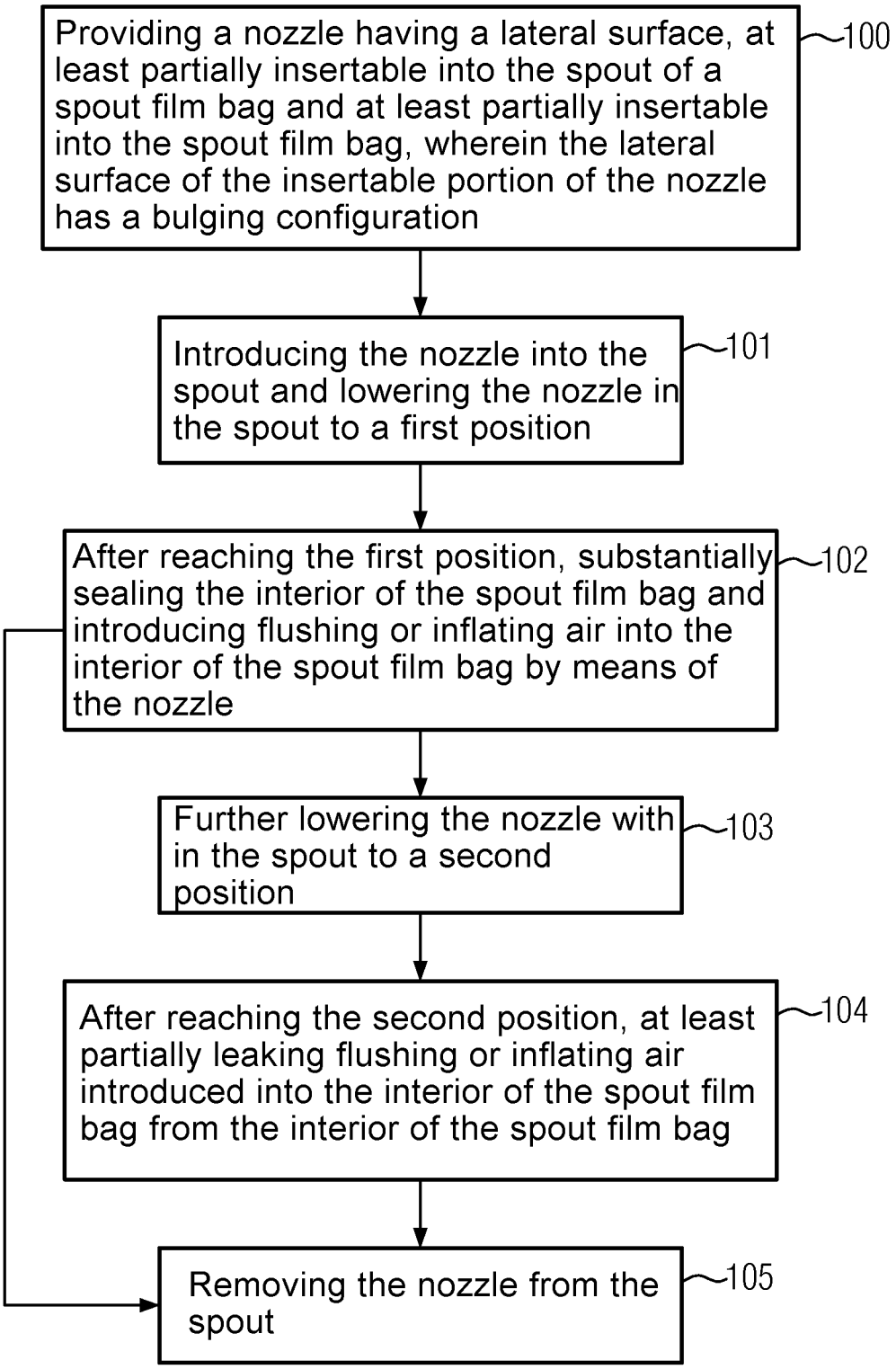
FIG. 8 is a flow chart of a method for inflating a spout film bag.

FIG. 8 illustrates a flow chart of a method for inflating a spout film bag, wherein a nozzle for inflating a spout film bag, as described above or below, is used.

In step 100, a nozzle is provided, the lateral surface of which is configured such that the nozzle is insertable at least partially into the spout of the spout film bag and at least partially into the spout film bag, wherein the lateral surface of the inserted portion of the nozzle is configured so as to have a bulging configuration, In step 101, the nozzle is inserted into the spout of the spout film bag and the nozzle within the spout is lowered to a first position.

After arrival at the first position in step 102, wherein the lateral surface of the inserted nozzle cooperates with the interior form of the spout such that the interior of the spout film bag is substantially sealed, flushing or inflating air is introduced into the interior of the spout film bag by means of the nozzle. Introducing the flushing or inflating air may be performed when the lowering of the nozzle after arrival at the first position is stopped or during a continuous lowering as long as the nozzle is at the first position, that is, as long as the interior of the spout film bag is substantially sealed.

In step 103, the nozzle within the spout is further lowered to a second position. This further lowering may be the continuation of the lowering after a stopping in step 102 or may be the continuation of a continuous lowering of the nozzle in the spout.

After arrival at the second position in step 104, wherein the lateral surface of the inserted nozzle cooperates with the interior form of the spout such that a spacing is formed, flushing or inflating air introduced into the interior of the spout film bag at least partially leaks from the interior of the spout film bag.

Starting from the first position or starting from the second position in step 105, the nozzle may be removed from the spout.

While there have been shown and described fundamental novel features of the invention as applied to the preferred and exemplary embodiments thereof, it will be understood that omissions and substitutions and changes in the form and details of the disclosed invention may be made by those skilled in the art without departing from the spirit of the invention. Moreover, as is readily apparent, numerous modifications and changes may readily occur to those skilled in the art. Hence, it is not desired to limit the invention to the exact construction and operation shown and described and, accordingly, all suitable modification equivalents may be resorted to falling within the scope of the invention as claimed. It is the intention, therefore, to be limited only as indicated by the scope of the claims appended hereto.

The invention claimed is:

1. A nozzle for inflating a spout film bag, comprising:

a lateral surface configured such that the nozzle is at least partially insertable into a spout of the spout film bag and also at least partially insertable into an interior of the spout film bag, wherein an insertable portion of the lateral surface of the nozzle has a bulging configuration, wherein a first circle of latitude of the lateral surface corresponds to the maximum circumference of the nozzle and wherein any other circles of latitude of the lateral surface have radii that are less than the radius of the first circle of latitude, wherein when the nozzle is inserted into the spout in a first position, the maximum circumference of the nozzle cooperates with an interior form of the spout such that the interior of the spout film bag is substantially sealed and flushing or inflating air is introducible into the interior of the spout film bag by the nozzle in the first position without leakage, and wherein when the nozzle is inserted at a second position, the lateral surface of the nozzle cooperates with the interior form of the spout such that a spacing is formed, through which introduced flushing or inflating air at least partially leaks from the interior of the spout film bag, wherein at the second position the nozzle is more deeply inserted into the spout, and the second position is reached when the maximum circumference of the nozzle is no longer positioned in the spout.

2. The nozzle of claim 1, wherein the lateral surface is defined by a rotating surface of a convex arc curve upon rotation around the longitudinal axis of the nozzle.

3. The nozzle of claim 1, wherein the first circle of latitude is substantially positioned in the middle of the nozzle.

4. A method for inflating a spout film bag by using a nozzle for inflating a spout film bag according to claim 1, comprising the steps:

providing a nozzle, a lateral surface of which is configured such that the nozzle is at least partially insertable into the spout of a spout film bag and also at least partially insertable into the spout film bag, wherein an insertable portion of the lateral surface of the nozzle has a bulging configuration, inserting the nozzle into the spout of the spout film bag and lowering the nozzle in the spout to a first position, after reaching the first position, wherein the maximum circumference of the nozzle cooperates with an interior form of the spout such that the interior of the spout film bag is substantially sealed, introducing flushing or inflating air into the interior of the spout film bag by the nozzle, further lowering the nozzle within the spout to a second position and after reaching the second position, wherein the lateral surface of the nozzle cooperates with the interior form of the spout such that a spacing is formed, causing flushing or inflating air introduced into the interior of the spout film bag to leak at least partially from the interior of the spout film bag, wherein at the second position the nozzle is more deeply inserted into the spout, and the second position is reached when the maximum circumference of the nozzle is no longer positioned in the spout.

5. The method of claim 4, further comprising the following step:

removing the nozzle from the spout.

* * * * *